United States Patent [19]

Drescher

[11] 3,938,207

[45] Feb. 17, 1976

[54] SWIMMER'S GLOVE HAVING JOINTS BENDABLE ONLY IN CLOSING DIRECTION OF THE HAND

[76] Inventor: Gary Clyde Drescher, 1000 Lindbergh Ave., Stroudsburg, Pa. 18360

[22] Filed: Oct. 25, 1973

[21] Appl. No.: 409,367

[52] U.S. Cl. ..... 9/308

[51] Int. Cl.[2] ..... A63B 31/02

[58] Field of Search ..... 9/301, 302, 303, 307, 308, 9/309; 24/116 A

[56] References Cited

UNITED STATES PATENTS

| | | | |
|---|---|---|---|
| 1,275,005 | 8/1918 | Eckman | 9/308 |
| 1,726,728 | 9/1929 | Adams | 9/308 |
| 2,078,133 | 4/1937 | Friedrich | 9/308 |
| 3,257,673 | 6/1966 | Rademacher | 9/308 |
| 3,328,812 | 7/1967 | Berthiot | 9/307 |

FOREIGN PATENTS OR APPLICATIONS

| | | | |
|---|---|---|---|
| 556,165 | 4/1958 | Canada | 9/307 |
| 538,979 | 3/1932 | Germany | 24/116 A |

*Primary Examiner*—George E. A. Halvosa
*Assistant Examiner*—Jesus D. Sotelo
*Attorney, Agent, or Firm*—Wenderoth, Lind & Ponack

[57] ABSTRACT

A swimmer's glove having a hand portion with hollow tubular fingers extending therefrom in a normal position for swimming and webs between the fingers. The joints joining the fingers to the hand portion and the joints in the fingers are constructed so that they will bend only in the closing direction of the hand. The hand and fingers of the swimmer are thereby reinforced against bending in the opening direction of the hand when force is exerted on the glove from the side toward the closing direction of the hand as the swimmer moves the glove through water while swimming, and the glove can be bent when the hand of the swimmer is closed.

31 Claims, 31 Drawing Figures

SWIMMER'S GLOVE HAVING JOINTS BENDABLE ONLY IN CLOSING DIRECTION OF THE HAND

BACKGROUND OF THE INVENTION AND PRIOR ART

This invention relates to a webbed swimming glove, and more particularly to such a glove which has finger and thumb enclosing tubular portions joined by webs, which tubular portions are capable of bending in the closing direction of the hand and fingers yet which are substantially rigid against bending past a predetermined position in the direction of the opening of the hand and fingers.

It is well known that a swimmer can increase the pressure of his hands on the water and thereby swim faster if he can wear some sort of glove on his hand which increases the area of the water contacted when his hand moves through the water. It is also well known that the best way to hold the hand when it is acting against the water to move the swimmer forward is to cup the hand.

It is, of course, possible to provide the swimmer with a hand attached paddle which is rigid and properly shaped such as disclosed in U.S. Pat. No. 3,328,812. Gloves, on the other hand, will flex so that the swimmer's hands can be used to grasp objects without removing the gloves.

Many prior art gloves have been developed in an attempt to increase the speed of a swimmer, but none of them have been entirely satisfactory. Most of them are simply a form of a conventional glove made of an appropriate flexible water impervious material with some sort of webbing between the fingers. One such glove is disclosed in U.S. Pat. No. 286,106. The fingers of the glove have even been extended in an effort to increase the area of the webbing which acts on the water during the hand movement through the water, as disclosed in U.S. Pat. No. 2,078,133, and reinforcing rods have been added to help support the webbing, as in U.S. Pat. Nos. 1,275,005, 1,712,655 and 1,777,050.

Some prior art gloves such as disclosed in Canadian Pat. No. 556,165, Italian Pat. No. 638,470 and French Pat. No. 1,248,039 have hinged joints but fail to provide a means to keep the hinged joints from buckling.

There are many drawbacks to the prior art gloves, some of which are the fact that they do not provide effective additional support to enable the hand to withstand the increased forces on it due to the presence of the web, that they cannot be adapted to cover the entire hand and that they do not make any provision for helping the swimmer cup his hand and keep it from buckling for the most efficient action on the water. The muscles of the hand and wrist are not sufficiently strong to stand up under the forces of a web significantly larger than the size of the hand moving through the water at the rate a swimmer can move his hand through the water, or in any event they will tire very quickly under the effect of such forces. It is even more difficult for a swimmer to keep his hand properly cupped when the forces of the water are exerted on a webbed glove as it is moved through the water. Even if he is able to cup his hand during the first few strokes with a prior art glove, his hand and wrist muscles will quickly tire and he will be unable to maintain the cup shape and keep the fingers from buckling.

OBJECTS AND BRIEF SUMMARY OF THE INVENTION

It is an object of the present invention to provide a webbed swimming glove of which not only provides added support for the swimmer's hand, but also supports the hand in a cup shape, yet which can be flexed so that the swimmer can grasp objects while the glove is still on his hand.

It is a further object of the present invention to provide such a glove which has an area considerably larger than the hand, yet which provides sufficient support to the hand so that it can be forced through the water without bending the fingers or the wrist back.

It is a further object of the invention to provide a swimmer's glove having an improved wrist closure means.

It is yet a still further object of the invention to provide such a glove which has appropriate reinforcing yet which is light in weight and easy to get on and off.

These objects are achieved by a swimmer's glove according to the present invention which has a hand portion and a plurality of tubular fingers extending from the hand portion in a normal position for swimming. Joints join the fingers to the hand portion and there is at least one joint along each of the fingers, preferably the first joint, outwardly of the hand portion. The fingers have at least one joint enlargement along each of the fingers outwardly of the joints. Flexible webs are provided between adjacent fingers. Each joint is constructed so that it will bend only in the closing direction of the hand and will block bending in a direction opposite the closing direction of the hand. The hand and fingers of the swimmer are reinforced against bending in the opening direction of the hand when force is exerted on the glove from the side toward the closing direction of the hand as the swimmer moves the glove through water while swimming, and the glove can be bent when the hand of the swimmer is closed. The wrist portion may be provided with a closure means which assists in keeping the fingers rigid.

BRIEF DESCRIPTION OF THE FIGURES

The invention will now be described with reference to the accompanying drawings, in which.

Figure 1:
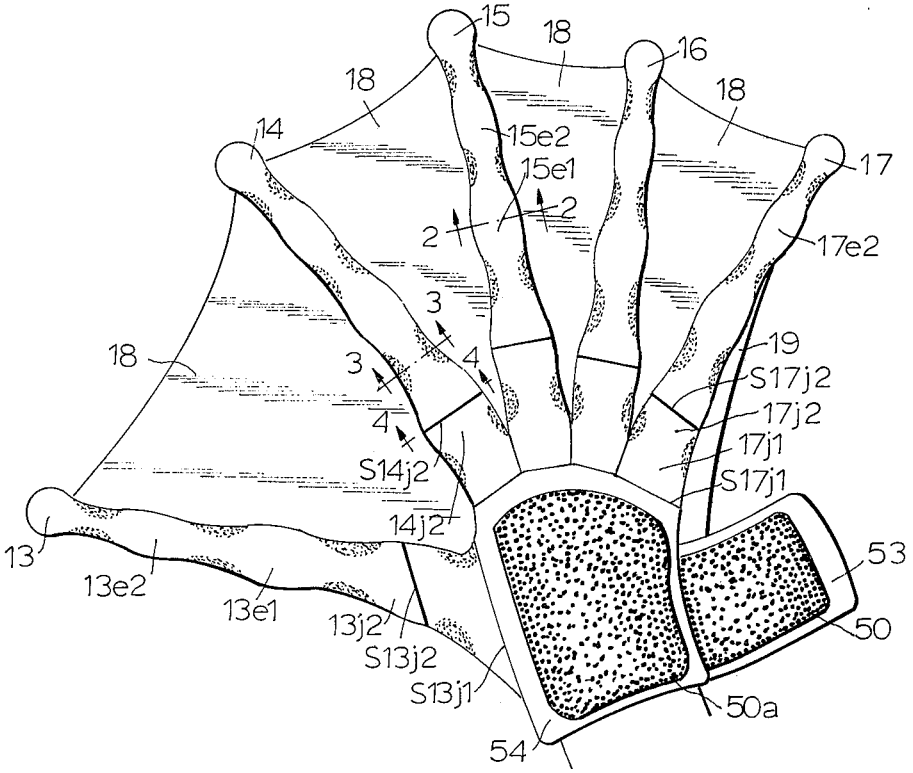
FIG. 1 is a plan view of the back of a swimmer's glove according to the invention.

In the following description, when reference is made to "fingers", this will generally be understood to include the thumb, unless it is specified otherwise. Also, the references to "upper" and "lower" are with respect to the glove in the position in the drawing, and correspond to the back of the glove and the palm of the glove, respectively.

DETAILED DESCRIPTION OF THE FIGURES

Figure 2A:
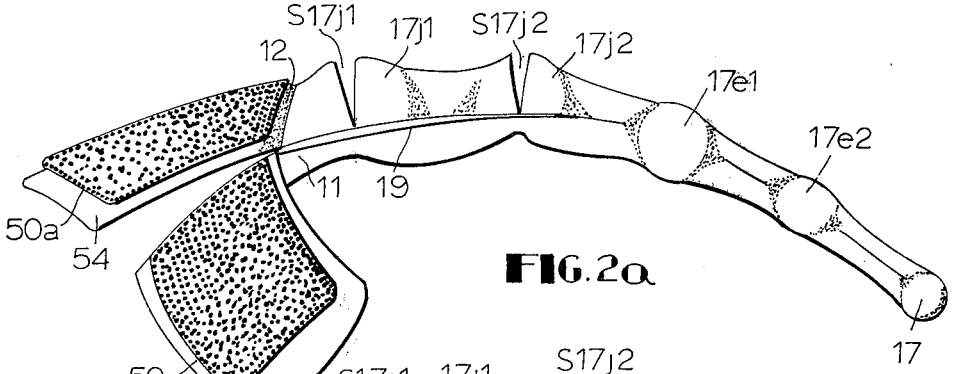
FIG. 2*a* is a side elevation of the glove of FIG. 1 as viewed from the right side of FIG. 1 and with the glove in the cupped or swimming position.
Figure 2B:
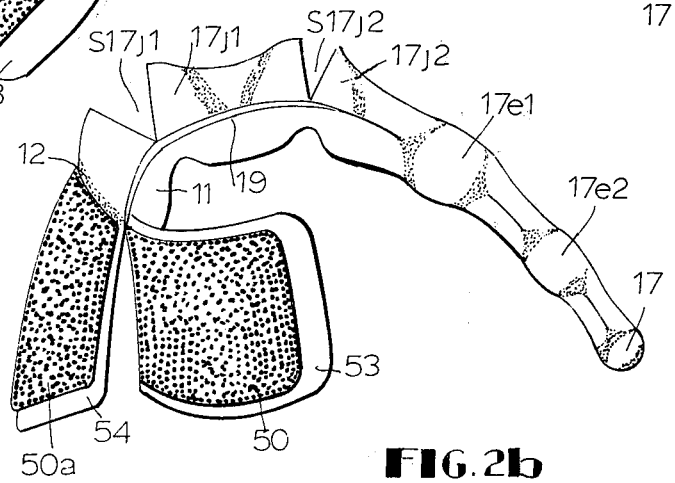
FIG. 2*b* is a view similar to FIG. 2*a* with the glove in the position with the hand closed more than in the cupped or swimming position.
Figure 3A:
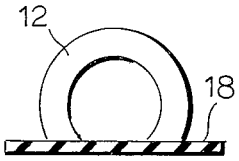
FIG. 3*a* is a section taken along line 4—4 of FIG. 1.
Figure 3B:
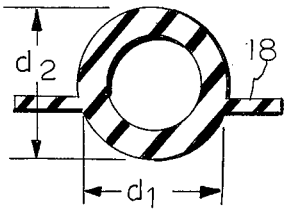
FIG. 3*b* is a section taken along line 3—3 of FIG. 1.
Figure 3C:
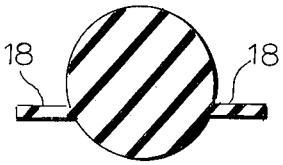
FIG. 3*c* is a section taken along line 2—2 of FIG. 1.

Referring first to FIGS. 1, 2*a* and 2*b*, there is shown a swimmer's glove having hand portion made up of a palm portion 11 and a back portion 12 of resilient material, such as molded rubber or plastic, preferably integrally joined or connected along at least the side edges between the little finger and the wrist, between the thumb and the forefinger, and between the thumb and the wrist. The palm 11 is relatively thin, non-stretchable and flexible, while the back 12 should be thick and is preferably rigid. Preferably, the portion of material directly below the joints and directly beneath the palm 11 has greater flexibility than the other parts of the glove.

Extending from the hand portions are a plurality of fingers shown in FIG. 1 as the thumb 13, the index finger 14, middle finger 15, ring finger 16 and little finger 17. Each of these fingers is a partially hollow generally tubular element, i.e. it is hollow along the portion closest to the palm, and is a solid cylindrical element toward the tip thereof. It is also of resilient material, such as molded rubber or plastic, and is joined to the hand portion by a joint and has at least one joint therealong, and outwardly of the joints from the hand portion a plurality of joint enlargements. The joints are designated by the number for the finger plus a subscript *j* and a number, while the enlargements are designated by the number for the finger plus a subscript e and a number. Thus, the joint between the hand portion and the index finger 14 is designated $14_{j1}$, while the joint at the first joint of the index finger is designated $14_{j2}$, the first enlargement on the index finger is designated $14_{e1}$, etc. The joints and enlargements may be of elipsoidally, rectangularly or spherically shaped portion preferably having a cylindrical bore through the interior and are joined by elongated tubular portions generally similar to the shape of the bones and knuckles and joints of the bullfrog Rana grylio. The cross-sectional shape of the tubular portions between the joints and enlargements may have a dimension $d_2$ in the direction of the thickness of the glove the same as or greater than the dimension $d_1$ in the direction of the plane of the glove, while the interior thereof is preferably generally cylindrical. When $d_2$ is greater, this gives greater rigidity to the fingers against forces perpendicular to the plane of the glove. In addition, it is preferable that reinforcing means be provided in the material of the lower portions of the fingers and extending along the entire length of the fingers. These reinforcing means will tend to be put under tension when the fingers are bent backwards, thus resisting such bending.

Also, clamps may be used along the fingers either between the joints and/or at the joints. The clamps may be located on the outside of the finger material or incorporated therein. The use of clamps along the finger portions are useful to prevent the reinforcing means from pulling out of the glove.

Between each two adjacent fingers is a web 18 of flexible material, such as rubber or plastic, which is preferably connected or integrally formed with the fingers and a web portion 19 formed between the outside edge of the finger 17 and hand portion.

Each of the joints has a lower portion which is integral or connecting with the portions on either side of it and is flexible but non-stretchable. Thus, the lower portion of the joints $17_{j1}$, shown in elevation in FIGS. 2*a* and 2*b*, is integral or connected with the palm portion 11 on one side of it and the first tubular portion of the little finger 17 on the other side of it, while the lower portion of the joint $17_{j2}$ is integral or connected with the first tubular portion of the little finger 17. The upper portion of each joint has a slit therein, the slits being given the number of the joint with the prefix *s*. Thus, the slit in the upper part of joint $17_{j1}$ is $s17_{j1}$. In the embodiment of FIGS. 1, 2*a* and 2*b*, the slits in the first joints of the fingers are preferably all straight. The slits in fingers 14–17 are generally perpendicular to the plane of the glove, while the corresponding slit in the joint in the thumb 13 is at an angle $\alpha$ about 60° to the length of the thumb being angled with the end closer to the wrist being closer to the hand portion 10. The slits at the joints between the fingers and the hands are preferably perpendicular to the plane of the glove. Thus the slit in the joint $13_{j1}$ between the thumb 13 and the hand portion 10 is a slit extending from the point between the thumb and the index finger to a point between the thumb and the wrist. There is a slit $s14_{j1}$ in the joint $14_{j1}$ between the hand portion and the index finger 14 and a slit $s16_{j1}$ in the joint $16_{j1}$ between the hand portion and the ring finger 16. There are slits in the joints $15_{j1}$ and $17_{j1}$ between the middle finger 15 and the little finger 17 and a slit $s13_{j1}$ in the thumb joint.

It will thus be seen that with the joints in the position in which the slits are closed, as in FIG. 2*a*, (the joints are shown slightly open for clarity — in practice they will be fully closed when the glove is in this position) the joints become rigid with respect to forces from the direction of the palm portion, and the fingers cannot be bent back in the direction opposing their normal cupped swimming position. On the other hand, as seen in FIG. 2*b*, lower portions of the joints can be bent when the fingers are bent toward the closed position of the hand, while the slits in the upper parts of the joints will open, thus allowing the wearer of the glove to close his hand in order to grasp objects or perform other operations. In other words, the joints are movable from a normal cupped position of the hand only in the direction of closing of the hand. When the glove is on the hand of a swimmer, therefore, the force exerted against the hand is resisted by the natural strength of the hand which is greatly reinforced by the structure of the glove, including the joints and the cross-sectional shape of the fingers together with the reinforcing in the hand portion of the glove, so that the swimmer can exert great force on the water. Since the position of the fingers when the joints become rigid against such forces is the desired cupped position, the swimmer's hand is kept in the most efficient swimming position during movement through the water. On the other hand, when the swimmer desires to close his hand for any reason, such as to grasp an object, the joints of the glove and the flexible non-stretchable lower portion bend easily.

As seen in FIGS. 4*a*–4*c* and 5*a*–5*c*, the finger portions of the glove may also take an elipsoidal or rectangular configuration with cylindrical holes for the wearer's fingers slowly decreasing in size toward the tips of the fingers.

In FIGS. 1, 2*a* and 2*b* one type of fastening means is shown, having a piece of easily releasable material such as the material sold under the trademark "Velcro", comprising a piece of Velcro material 50, on one wrist flap 53 which is engagable with another piece of complementary material 50*a* on the other wrist flap 54, or vice versa, to secure the wrist portion of the glove around the wrist of the wearer. However, it is understood that any conventional type of wrist fastening means may be used.

Figure 6:
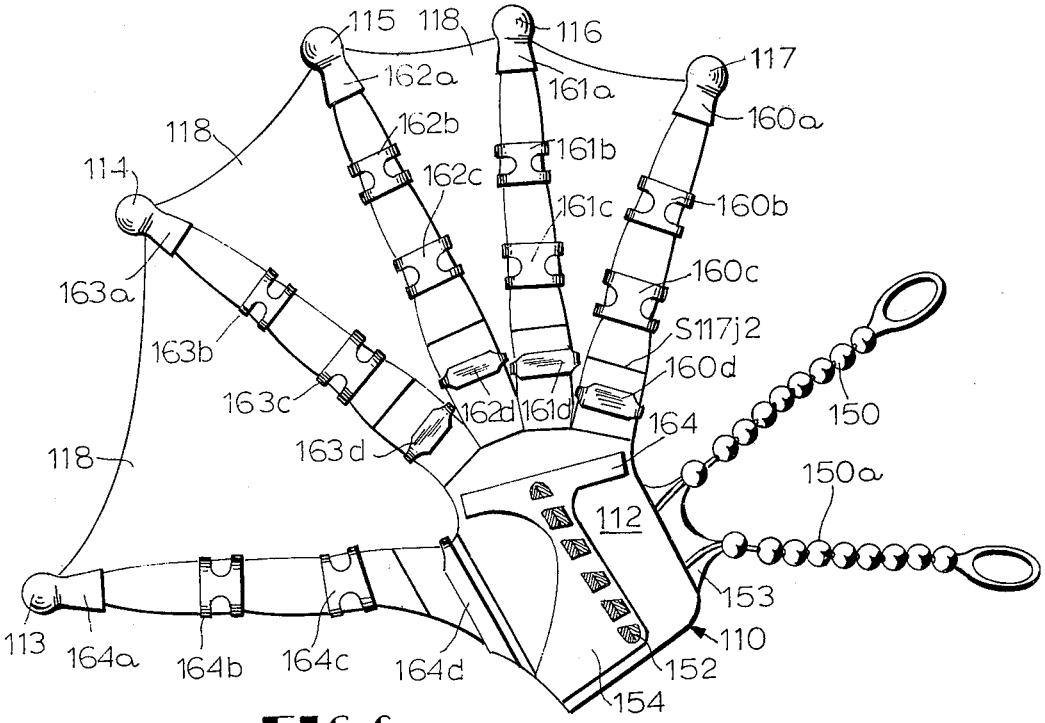
FIG. 6 is a plan view of the back of another form of swimmer's glove according to this invention.
Figure 7:
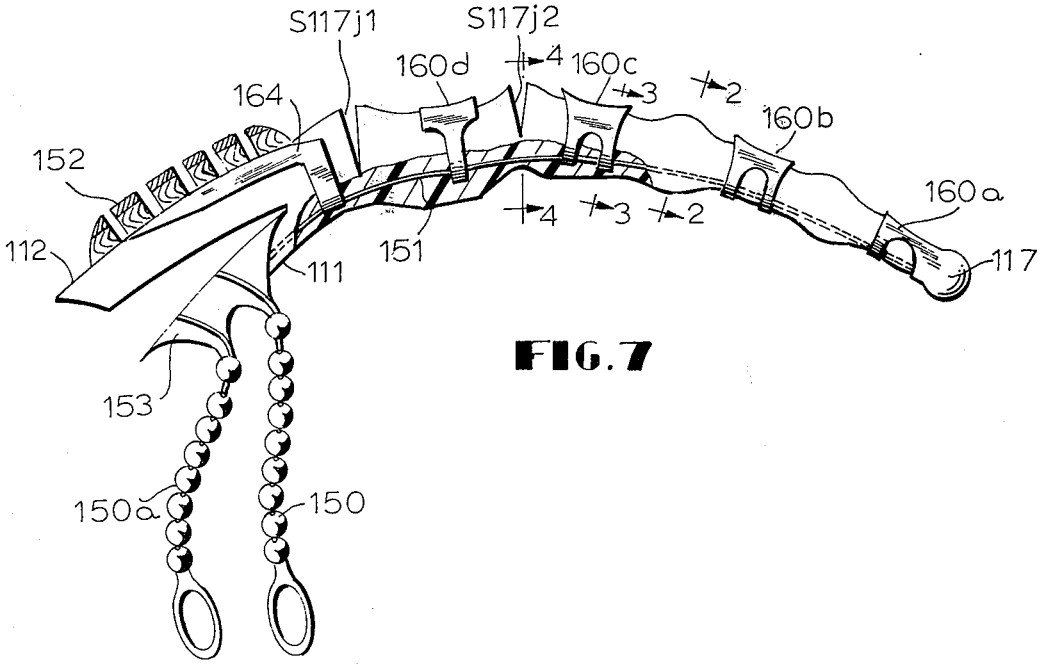
FIG. 7 is a side elevation of the glove of FIG. 6 as viewed from the right side of FIG. 6 with the glove in the swimming position.
Figure 8:
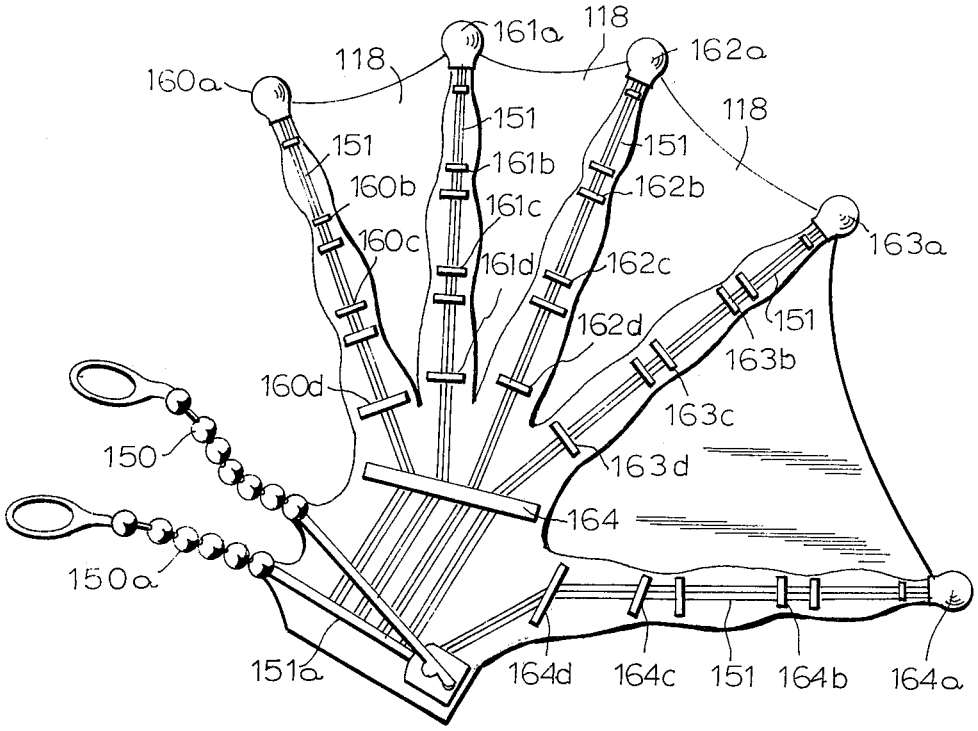
FIG. 8 is a plan view partly in section, of the palm side of the glove of FIG. 6.

FIGS. 6–8 show another form of the swimmer's glove according to this invention using reinforcing means.

There is shown a swimmer's glove similar to that of FIG. 1 having hand portion 110 made up of a palm portion 111 and a back portion 112 of resilient material, preferably integrally joined or connected along at least the side edges between the little finger and the wrist, between the thumb and the forefinger, and between the thumb and the wrist. The palm 111 is relatively thin, nonstretchable and flexible, while the back 112 is preferably rigid.

Extending from the hand portions 110 are a plurality of fingers shown in FIG. 6 as the thumb 113, the index finger 114, middle finger 115, ring finger 116 and little finger 117. Each of these fingers is a partially hollow generally tubular element also of resilient material and is joined to the hand portion by a joint and has at least one joint therealong, and outwardly of the joints from the hand portion a plurality of joint enlargements similar to FIG. 1. Also, closure means comprising beaded members 150, 150*a* on one wrist flap 153 are engageable between raised portions 152 on the other flap 154. The joints and enlargements are generally spherically shaped portions preferably having a cylindrical bore through the interior and are jointed by elongated tubular portions. The glove is provided with reinforcing means 151 (visible only in FIGS. 7 and 8) in the material of the lower portions of the fingers and extending along the entire length of the fingers and a substantial portion of the palm. These wires will tend to be put under tension when the fingers are bent backwards, thus resisting such bending. The reinforcing means 151 may consist of nonstretchable strands of wires, nylon, plastic cord, string, and the like.

Along the glove are clamp means of generally rigid and nonflexible material to which the reinforcing means are attached. The clamp means keep the reinforcing means from pulling out of the glove. As shown in FIGS. 6–8, on finger 117 are clamps 160*a*, *b*, *c*, *d*; and on thumb 113 are clamps 164*a*, *b*, *c*, *d*. Additionally, other clamps such as clamp 164 may be used.

Although there is shown clamp means on the fingers as being between the joints, it is understood that the clamps may be so constructed so as to be placed over the joints or slits.

As seen in FIG. 7, there are clamp means 160*c* and 160*d* on each side of slit $s117_{j2}$. On one side of slit $s117_{j1}$ is a clamp 164 which extends toward the rear of the glove.

Although at the tips of the fingers are shown clamps over the entire tip portion, a clamp similar to the other finger clamps may be used.

As shown in FIG. 8 the reinforcing means 151 of the thumb portion is connected with the closure means 150 and 150*a* by reinforcing means 151*a* so as not only to strengthen the attachment of the closure means 150 and 150*a* but also to allow for more tightening of the overall structure of the reinforcing means.

Figure 8A:
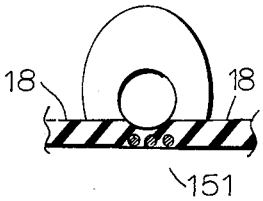
FIG. 8*a* is a section taken along line 4—4 of FIG. 7.
Figure 8B:
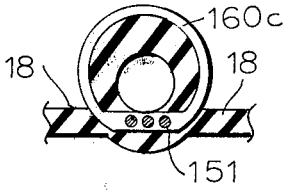
FIG. 8*b* is a section taken along line 3—3 of FIG. 7.
Figure 8C:
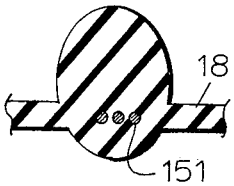
FIG. 8*c* is a section taken along line 2—2 of FIG. 7.

In FIGS. 8*a*, *b*, *c*, the reinforcing means 151 is shown as being incorporated in the glove material and the clamp means 160*c* is partially in the glove material. However, the clamp means may be entirely within the glove material. Alternatively the reinforcing means can be on the palm surface of the glove material and the clamp means entirely outside of the glove material.

Figure 4A:
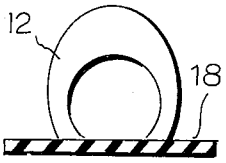
FIG. 4*a* is a section taken along line 4—4 of FIG. 1 is an elipsoidal configuration.
Figure 4B:
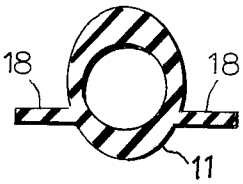
FIG. 4*b* is a section taken along line 3—3 of FIG. 1 in an elipsoidal configuration.
Figure 4C:
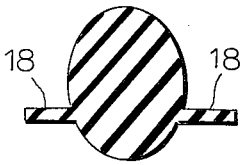
FIG. 4*c* is a sectional taken along line 2—2 of FIG. 1 in an ellipsoidal configuration.
Figure 5A:
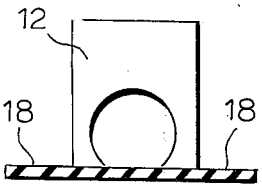
FIG. 5*a* is a section taken along line 4—4 of FIG. 1 in a rectangular configuration.
Figure 5B:
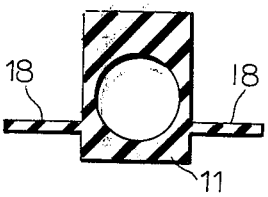
FIG. 5*b* is a section taken along line 3—3 of FIG. 1 in a rectangular configuration.
Figure 5C:
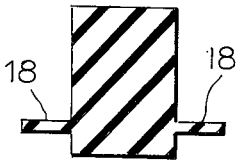
FIG. 5*c* is a section taken along line 2—2 of FIG. 1 in a rectangular configuration.

Additionally, the finger portions may have an elipsoidal or rectangular configuration the same as is shown for the embodiments of FIGS. 4*a*, *b*, *c*, and 5*a*, *b*, *c*.

Figure 9:
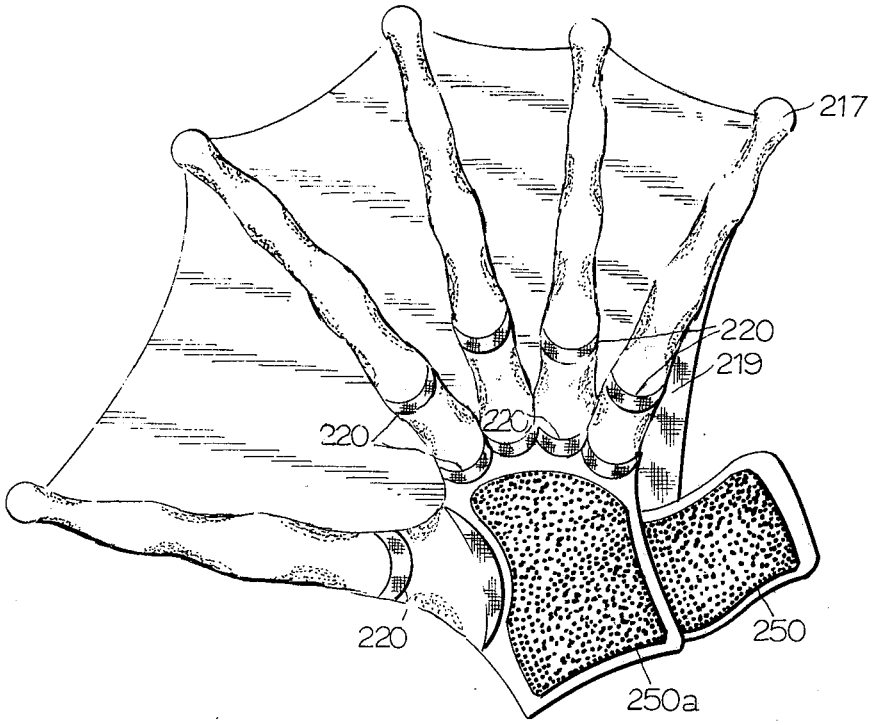
FIG. 9 is a plan view of the back of a further form of a swimmer's glove according to this invention.
Figure 10:
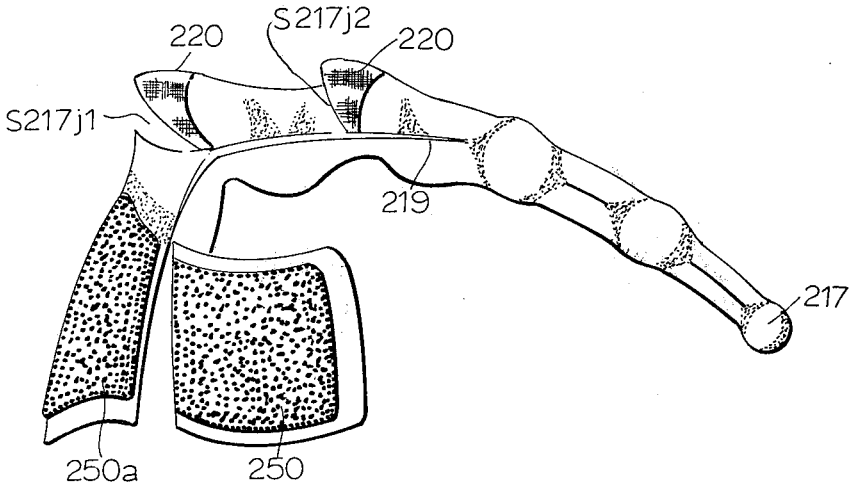
FIG. 10 is a side elevation of the glove of FIG. 9 as viewed from the right side of FIG. 9.

In the embodiment of FIGS. 9 and 10, there is shown a closure means 250, 250*a*, one of which is an easily releasable material sold under the trademark "Velcro" and the other a complementary material similar to the closure means of FIGS. 1, 2*a*, and 2*b*. A web 219 along finger 217 is also provided.

As shown in FIG. 10, the slits in the glove are curved and have a protective cover 220 to prevent the entrance of foreign matter. The cover 220 may entirely cover the slit as shown over slit $s217_{j2}$ or partially when completely open as shown over slit $s217_{j1}$. The covers may take any shape desired such as curved, V-shaped, rectangular, etc.

Because the knuckle joints between the fingers and the hand are larger than the other joints, some modification of the joints of the glove of the present invention between the fingers and the hand portion to improve the action of the glove at this point may be desirable. These joints may be modified to curve the slit slightly and place it substantially in a plane which is tilted rearwardly, i.e. toward the hand portion, from a position perpendicular to the axis of the fingers. This makes the slits, which are curved, appear substantially straight, because they extend along the periphery surface of the spherical joint, although as seen from FIG. 10, the curvature of the plane of the slit is really rather slight. This form of joint increases the area of the joint which is opened by the slit slightly, thereby giving somewhat freer movement to the fingers when the glove is in the open position. When in the closed position, the type of slit has no bearing on the mobility of the fingers.

Figure 11:
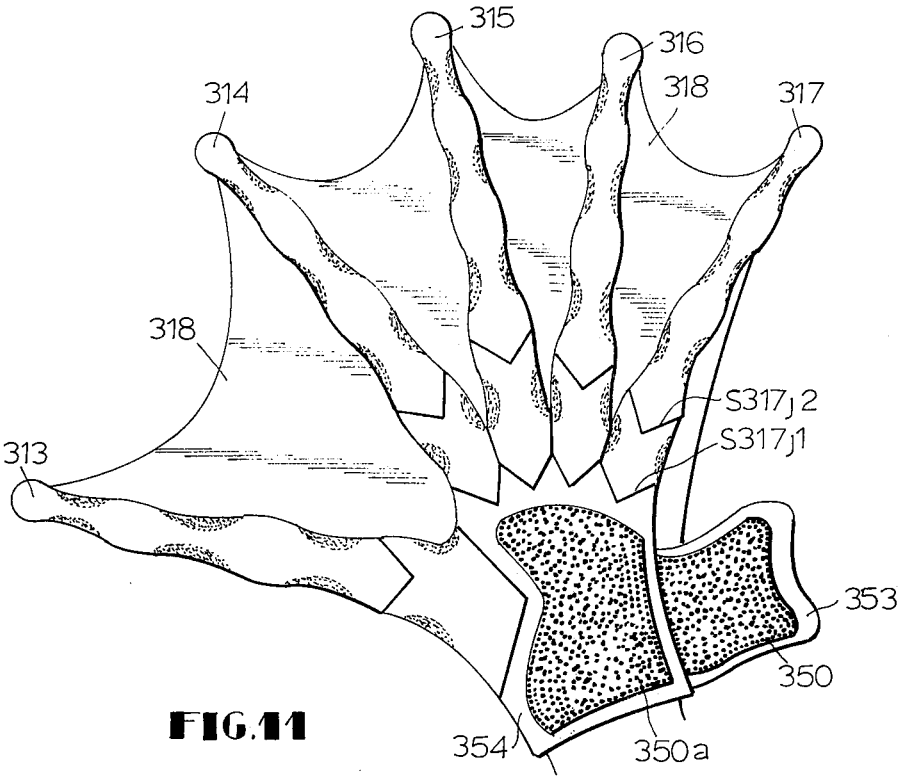
FIGS. 11 and 11a are a plan views of the back of still further forms of a swimmer's glove of this invention having V-shaped slits.
Figure 11A:
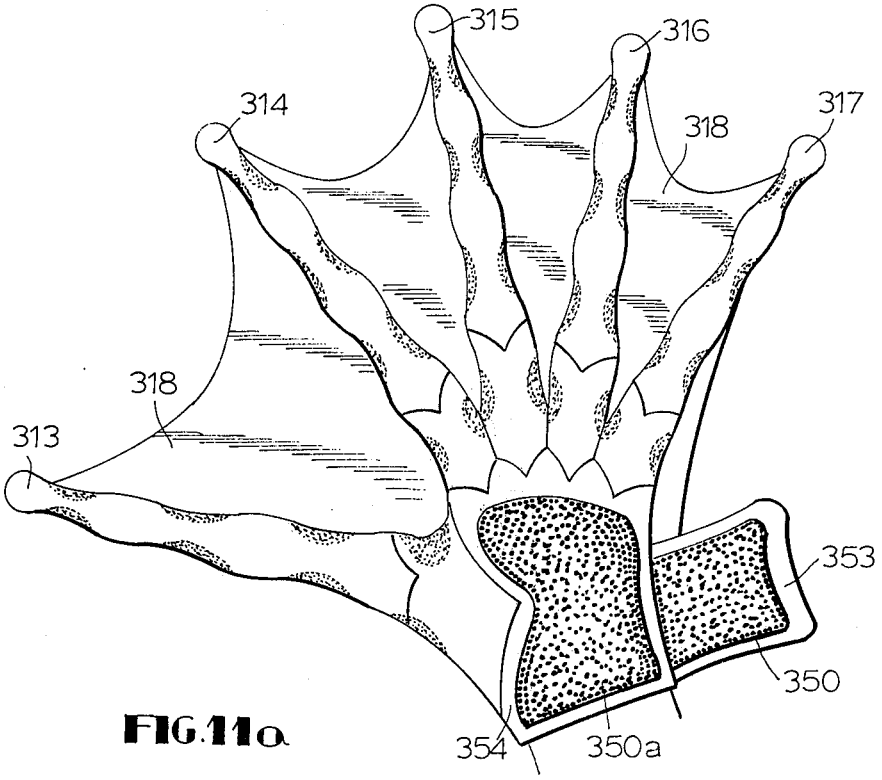

FIGS. 11 and 11a illustrate further embodiments of the glove of this invention which contain a "Velcro" closure means 350, 350*a* on the wrist flaps 353, 354. The web 318 between the finger portions 313, 314, 315, 316 and 317 are provided therebetween with a modified web 318 which is shorter and curved inwardly toward the wrist so as to decrease the pressure on the fingers during swimming and to provide more finger space for grasping objects.

There is also provided on the glove of FIG. 11 V-shaped slits the portions of which are straight and with the apexes toward the hand portion as seen on finger 317 as $s317_{j2}$ and $s317_{j1}$. However, it is understood that although only V-shaped slits are shown in FIG. 11, the slits may be varied throughout the glove. FIG. 11*a* shows V-shaped slits the portions of which are curved.

Figure 12:
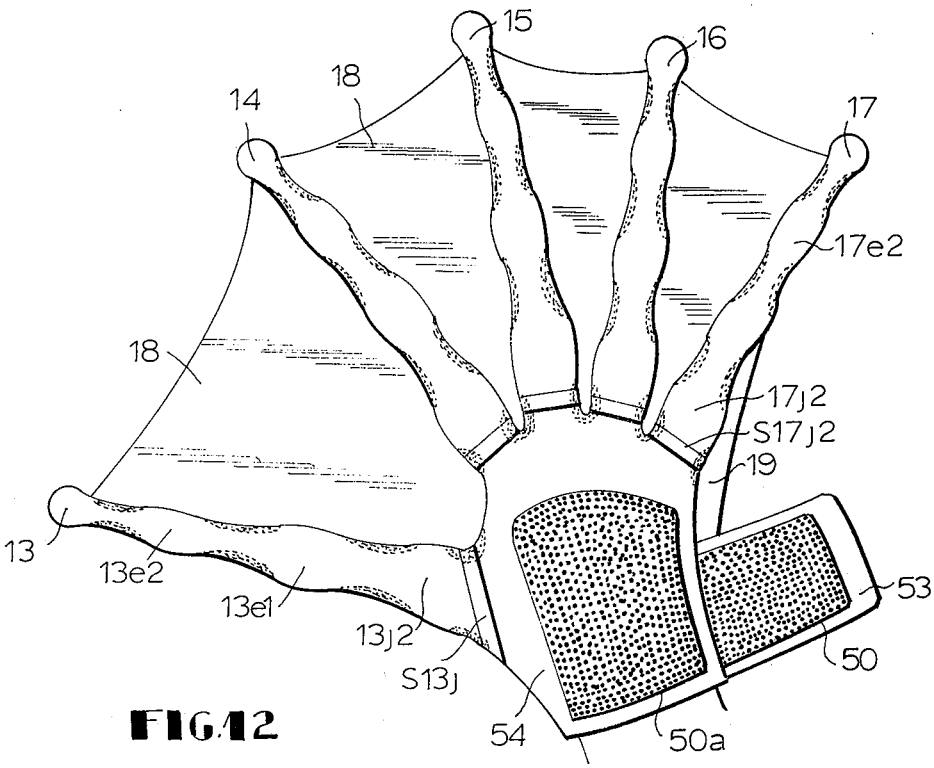
FIG. 12 is a plan view of the back of a yet still further form of a swimmer's glove according to this invention.
Figure 13A:
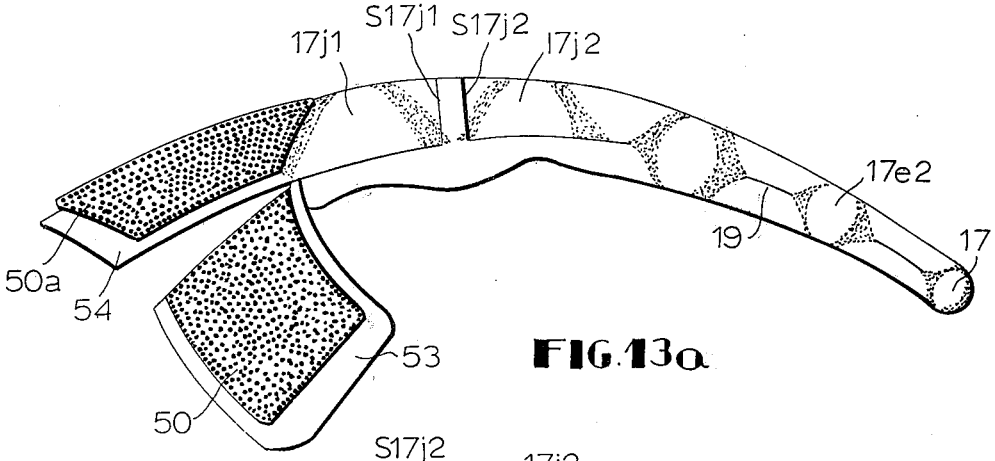
FIG. 13*a* is a side view of the glove of FIG. 12 as viewed from the right side of FIG. 12.
Figure 13B:
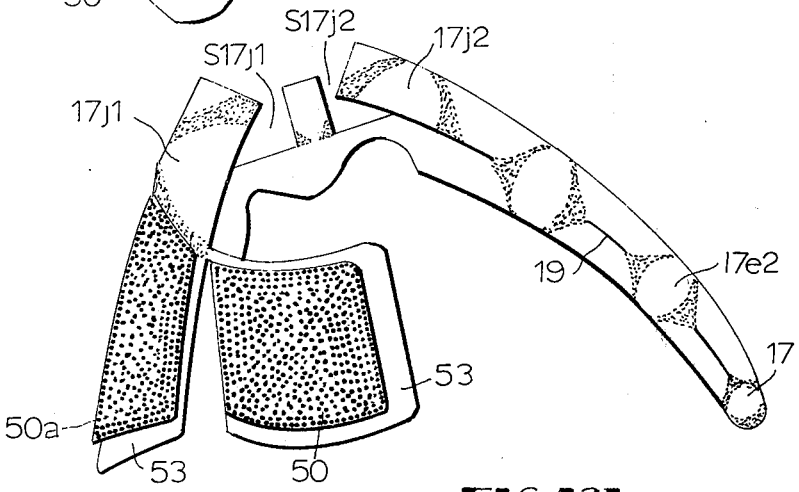
FIG. 13*b* is a side view of the glove of FIG. 12 in the grasping position.

FIGS. 12, 13*a* and 13*b* show a glove similar to that illustrated in FIG. 1 however, the above has been modified by providing a double slit $s17_{j1}$ and $s17_{j2}$, as shown in FIG. 13*b*, on each of the finger sections between the joints $_{j1}$ and $_{j2}$. It is seen in FIG. 13*b* that the slits $s17_{j1}$ and $s17_{j2}$ are perpendicular to the axis of the finger portions and then run along the finger portion to the center of the joints. The slits thus permit the finger postions to open as shown in FIG. 13*b*.

Figure 14:
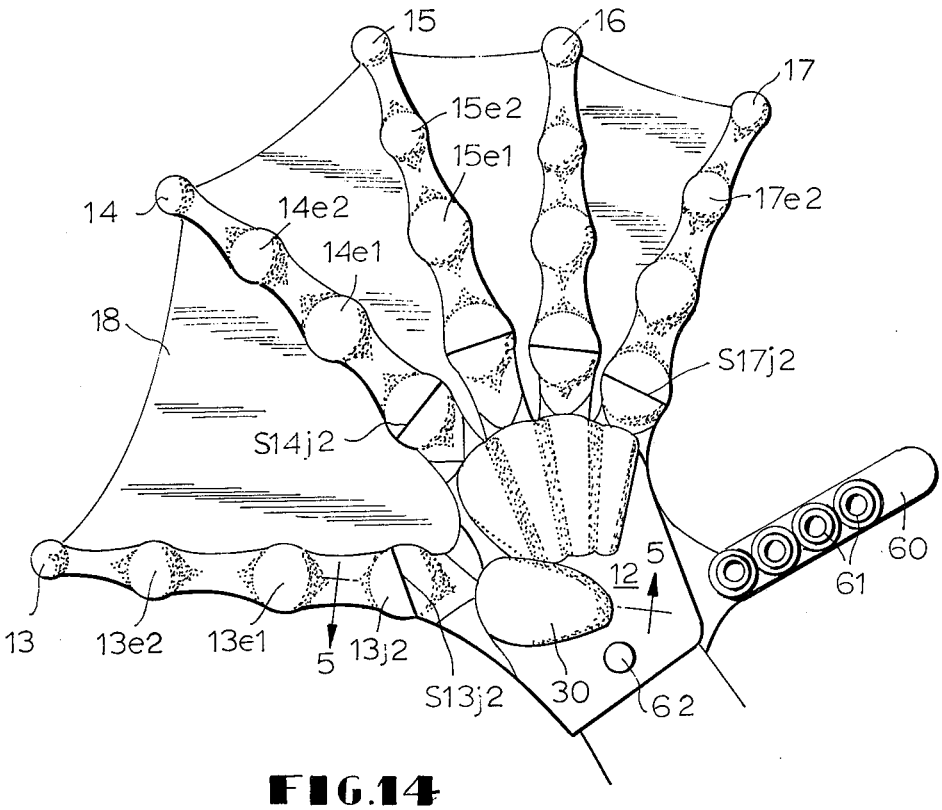
FIG. 14 is a plan view of the back of another form of a swimmer's glove according to this invention.
Figure 14A:
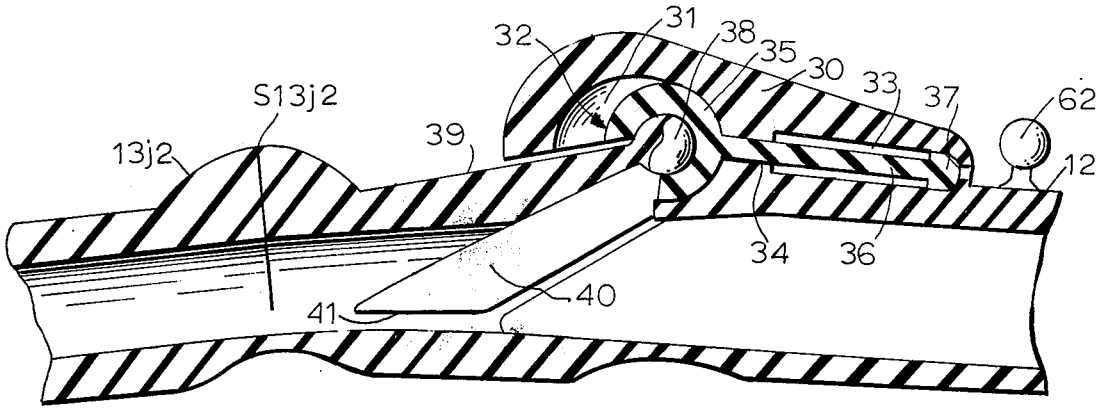
FIG. 14*a* is a section taken along line 5—5 of FIG. 14.

The type of joint between the fingers and the hand portion which may be used with the glove of FIG. 1 and which gives still greater freedom is shown in FIGS. 14 and 14*a*. The joint comprises a socket holder 30 integrally formed with the back 12 of the glove, and having a recess 31 at the front thereof with a shape to receive a socket member 32. A slot 33 is provided in the rear position of the socket holder 30 and an aperture 34 joins the slot 33 and the recess 31. The socket member 32 has a hollow socket 35 on the front end having an external shape to fit snugly in the recess 31, and extending rearwardly from the socket 35 is an extension 36 which is slidable in the aperture 34. On the rear end of the extension 36 is a stop 37 which is slidable in the slot 33, but which is too big to pass through the aperture 34. The first tubular portion 39 of the finger has a ball 38 on the end toward the hand portion which is rotatably fitted into the socket 35. The sides of the upper portion of the first tubular position 39 are cut away as at 40 down to a line 41 just slightly above the lower interior of the finger.

When the fingers are bent in the direction of closing the hand, the ball 38 will pull the socket 35 as the tubular finger portion 39 is pulled forwardly, thus pulling the extension 36 through the aperture 34. If desired, extension 36 can be made sufficiently short so that the stop 37 abuts the forward end of the slot 33 at the fully bent position of the joint. This joint structure is in the nature of a positive action articulated joint, in that the amount of joint movement is positively limited. It will be appreciated that the parts of the joint cannot be moved from the positions shown in the drawings in the direction of opening of the hand, since the socket 35 is seated in the recess 31, and the ball 38 is in the socket 35. The joint will therefore resist forces on the hand tending to bend the hand in the opening direction.

Figure 15:
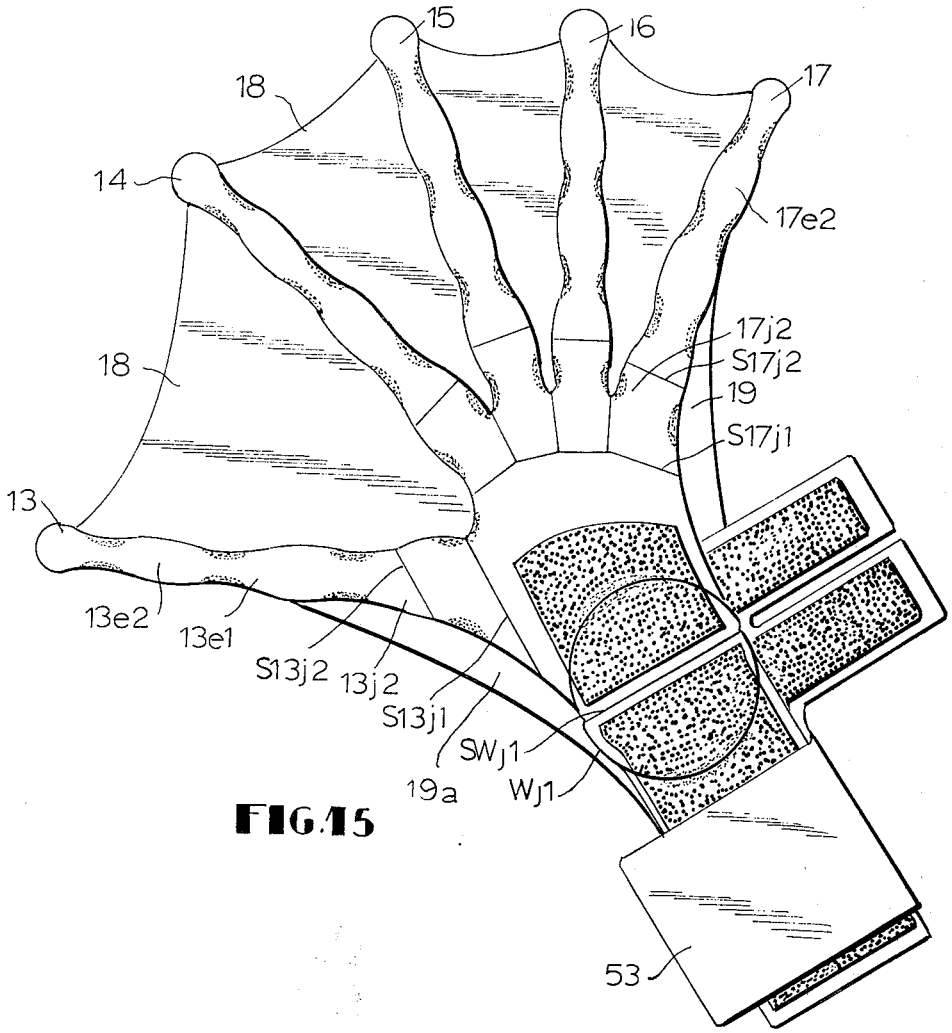
FIG. 15 is a plan view of a modified swimmer's glove as shown in FIG. 1.
Figure 15A:
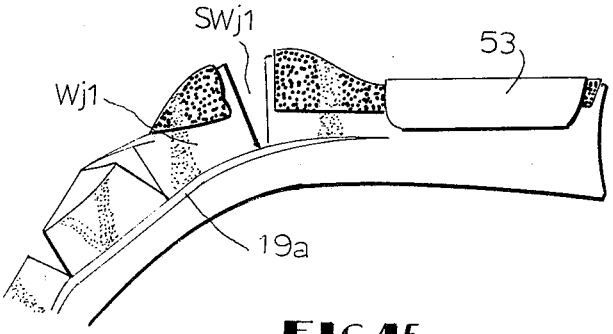
FIG. 15*a* is a side view of the glove of FIG. 15.

A joint such as is provided at the knuckles of the finger portions of the glove can also be provided at the wrist portion of the glove to provide reinforcement of the wrist of the swimmer against the pressure of the water as the hand, wrist and arm move through the water. Such a joint is shown in FIGS. 15 and 15*a*. There is provided a slit $sw_{j1}$ on the wrist joint enlargement $w_{j1}$.

Another form of easily attachable and releasable fastening means are provided for the wrist portion of the glove. Several forms of such means are shown in the various figures, and are more or less conventional, being shown only for the purposes of illustrating practical embodiments of such means. The features common to all of them are ease of fastening and unfastening. In FIGS. 14 and 14a the fastening means shown is a snap having a female portion 61 on one wrist flap 60 which can be engaged with a male portion 62 on the other wrist flap.

In FIG. 15, a web portion 19 is provided on finger 17 which extends to the wrist portion. There is also a web portion 19*a* on the thumb 13 which also extends to the wrist portion.

Figure 16:
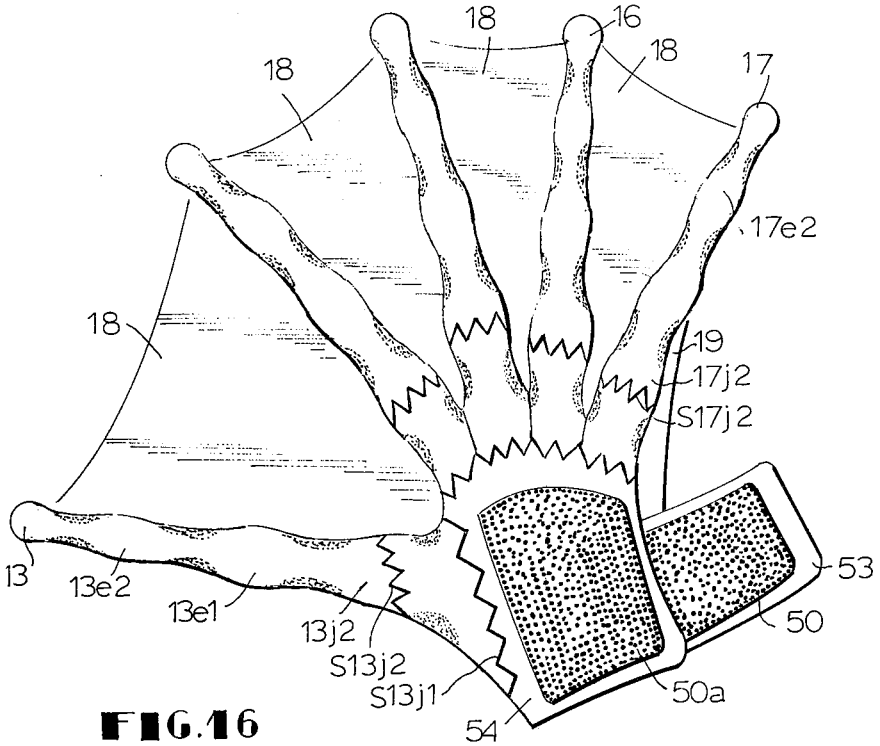
FIG. 16 is a plan view of the back side of a swimmer's glove according to FIG. 1 having modified slits.

The glove of FIG. 16 is another embodiment of the glove of FIG. 1 wherein all the slits are in a sawtoothed configuration. All the slits are perpendicular to the plane of the glove.

Figure 17:
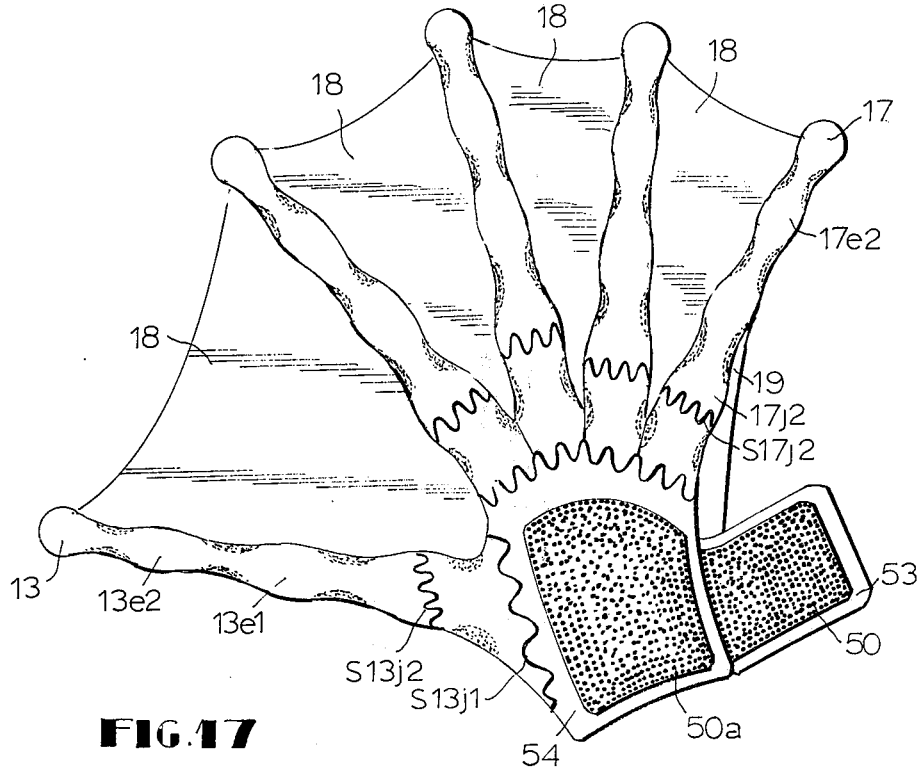
FIG. 17 is a plan view of the back side of a swimmer's glove according to FIG. 1 having another form of slit.

FIG. 17 shows another form of the glove of FIG. 1 wherein the slits are of a rounded off sawtooth configuration.

In each of the gloves illustrated the rigid upper portions may be made of the same or different material and may be made integral with one another or joined by any conventional means. It is understood that if the upper and lower portions are of the same material, the upper portion can be made rigid by increasing the thickness.

The lower or palm portion may be of any suitable flexible, non-stretchable material which can be joined with the upper portion. The lower portion can be either of rubber, plastic, canvas material or the like. Preferably, the lower portion is of a material which can be easily manufactured with the reinforcing means therethrough as previously shown.

It is further understood that although the fingers of the glove have been singularly shown as being spherical, elipsoidal or rectangular, any combination of shapes may be used.

Also, the type and angle of the slits may be varied and any combination may be used depending upon the specific requirements of the wearer and of the type and thickness of materials used in the manufacture of the glove. The mobility of the fingers in the grasping position is not dependent upon the shape of the slit. However, a curved slit has been found to provide greater mobility of the fingers in an open position.

The web portions of the glove of this invention may be of the same or different material than the other glove members. The web portion is preferably either attached to the fingers halfway between the upper and lower portions of the glove or on the lower portion only. The degree of flexibility of the web portions is based on the requirements of the wearer and may vary by the degree of thickness of the web at different areas.

While molded rubber or plastic has been mentioned as a material of which the glove according to the invention can be made, and while this is preferred material, other materials such as fabric reinforced rubber, plastic, fabric reinforced plastic, and the like can also be used.

It will be further appreciated that the size of the glove can be decreased or increased by removing or adding enlargements and finger portions to the fingers, and increasing or decreasing the size of the webs between the fingers. The relative size and number of enlargements shown are preferred, but for some special purposes, different numbers, shapes and sizes may be desirable. It will be further appreciated that while only a right-hand glove has been shown, if a pair is desired, a left hand glove can be made in a mirror image to the glove as shown and described.

It is thought that the invention and its advantages will be understood from the foregoing description, and it is apparent that various changes may be made in the form, construction and arrangement of the parts without departing from the spirit and scope of the invention or sacrificing its material advantages, the form hereinbefore described and illustrated in the drawings being merely a preferred embodiment thereof.

What is claimed is:

1. A swimmer's glove comprising a hand portion having a palm portion of flexible-non-stretchable material and a back portion, a plurality of partially hollow generally tubular fingers extending from said hand portion in a normal position, joints joining said fingers to said hand portion, one of said fingers being a thumb, at least one joint along each of said fingers other than said thumb outwardly of said hand portion, at least one joint enlargement along each of said fingers other than said thumb outwardly of said and along said thumb outwardly of said joint between said thumb and said hand portion, and flexible webs between adjacent fingers, each joint having a lower portion on the palm side of the glove which is connected with the portions of the glove on either side thereof and having an upper portion projecting at least to the backside of the glove and including means for permitting bending of the joint in the closing direction of the hand and whereby the hand and fingers of the swimmer are reinforced against bending in the opening direction of the hand when force is exerted on the glove from the side toward the closing direction of the hand as the swimmer moves the glove through the water while swimming, and the glove can be bent easily around the lower portions of the joints when the hand of the swimmer is closed.

2. A swimmer's glove comprising a hand portion having a palm portion of flexible, nonstretchable material and a back portion, a plurality of partially hollow generally tubular fingers extending from said hand portion in a normal position, joints joining said fingers to said hand portion, at least one joint along each of said fingers outwardly of said hand portion, at least one joint enlargement along each of said fingers at said joint along said finger, and flexible webs between adjacent fingers, each joint having a lower portion on the palm side of the glove which is connected with the portions of the glove on either side thereof for forming a flexible, non-stretchable hinge, and having an upper portion projecting at least to the back, side of the glove and including means for permitting bending of the joint in the closing direction of the hand and for reinforcing the hand and fingers of the swimmer against bending in the opening direction of the hand when force is exerted on the glove from the side toward the closing direction of the hand as the swimmer moves the glove through the water while swimming, and the glove can be bent easily around the lower portion of the joints when the hand of the swimmer is closed.

3. A swimmer's glove as claimed in claim 2 in which the hollow tubular fingers have finger portions extending between the joints and enlargements which have a cross-sectional dimension in a direction of the thickness of the glove which is greater than the cross-sectional dimension in the plane of the glove.

4. A swimmer's glove as claimed in claim 2 in which said normal position is a position in which the fingers are curved in the direction of the closing of the hand to form a cup.

5. A swimmer's glove as claimed in claim 2 in which said joints are generally spherical joints, and the means in said upper portion comprise a slit.

6. A swimmer's glove as claimed in claim 5 in which said joints in said fingers have straight slits transverse to the length of said fingers.

7. A swimmer's glove as claimed in claim 6 in which one of said fingers is a thumb, and said thumb has at least one joint therein adjacent the joint between the thumb and the hand portion, said slit being at an angle to the length of the thumb with the end of the slit closer to the wrist of the swimmer being closer to the hand portion.

8. A swimmer's glove as claimed in claim 7 in which the joints between the fingers and the hand portion have straight slits generally transverse to the length of the fingers.

9. A swimmer's glove as claimed in claim 2 in which the joints between the fingers and the hand portion have slits with portions at angles to each other.

10. A swimmer's glove as claimed in claim 9 in which the slits are V-shaped with the portions of the slits being straight.

11. A swimmer's glove as claimed in claim 9 in which the slits are V-shaped with the portions of the slits being curved.

12. A swimmer's glove as claimed in claim 9 in which the slits are sawtoothed slits.

13. A swimmer's glove as claimed in claim 9 in which the slits are rounded off sawtoothed slits.

14. A swimmer's glove as claimed in claim 2 in which the joints are generally elipsoidal joints.

15. A swimmer's glove as claimed in claim 2 in which the joints are generally rectangular joints.

16. A swimmer's glove as claimed in claim 2 in which the joints between the fingers and the hand portion are curved slits.

17. A swimmer's glove as claimed in claim 2 in which said joints each have a cover portion thereon extending over the slit toward the hand portion so as to prevent entrance of foreign matter.

18. A swimmer's glove as claimed in claim 2 in which said joints are generally spherical joints, and the means in said upper portion of the joints between the fingers and the hand portion comprise a socket holder on one of the fingers and hand portion, said socket holder having a recess at the end thereof toward the other of said fingers and hand portion, said socket holder having a slot in the part remote from the recess and having an aperture between the recess and the slot, a socket member having a hollow socket on one end thereof having an external shape fitting in said recess and having an extension extending from said socket member through said aperture into said slot and having a stop on the end of said extension larger than said aperture, and a ball on the other of said fingers and hand portion rotatably held in said hollow socket.

19. A swimmer's glove as claimed in claim 2 wherein said palm portion includes flexible reinforcing means to reinforce the fingers during swimming.

20. A swimmer's glove as claimed in claim 19 wherein said reinforcing means is incorporated in the palm portion and extends throughout the fingers and palm portion.

21. A swimmer's glove as claimed in claim 19 in which said reinforcing means are strands of flexible material.

22. A swimmer's glove as claimed in claim 19 including clamp means to keep the reinforcing means from pulling out of the glove.

23. A swimmer's glove as claimed in claim 22 in which said clamp means are attached to the reinforcing means and incorporated in the back portion.

24. A swimmer's glove as claimed in claim 23 in which said clamp means is between the joints.

25. A swimmer's glove as claimed in claim 2 wherein each joint has a pair of adjacent slits, each slit having a portion perpendicular to the axis of the finger and a portion extending along the finger, the portions of the slits extending along the finger extending from the inner ends of the perpendicular portions and away from each other.

26. A swimmer's glove as claimed in claim 2 further comprising a web portion extending along the outside of the finger at one side of the glove and a wrist portion to which said palm portion and said back portion are attached and to which said web portion is joined.

27. A swimmer's glove as claimed in claim 2 further comprising a web portion extending along the outside of the fingers on each side of the glove and a wrist portion to which said palm portion and said back portion are attached and to which said web portions are joined.

28. A swimmer's glove as claimed in claim 2 further comprising a wrist portion to which said palm portion and said back portion are attached and further including wrist closure means.

29. A swimmer's glove as claimed in claim 28 wherein said wrist portion has a pair of wrist flaps and said closure means comprises a beaded member on one wrist flap and a cooperating raised portion on the other wrist flap.

30. A swimmer's glove as claimed in claim 29 including reinforcing means cooperating with said closure means.

31. The swimmer's glove as claimed in claim 2 further comprising a wrist portion to which said palm portion and said back portion are attached and extending over the wrist so as to support the wrist, said wrist portion having an enlargement over the wrist with a slit therein and wrist closure means.

* * * * *

UNITED STATES PATENT AND TRADEMARK OFFICE

CERTIFICATE OF CORRECTION

PATENT NO. : 3,938,207

DATED : February 17, 1976

INVENTOR(S) : Gary Clyde Drescher

It is certified that error appears in the above-identified patent and that said Letters Patent are hereby corrected as shown below:

Column 9, line 33, after "said" (second occurrence) should read --joint--.

Column 9, line 56, delete "at" and insert --outwardly of--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*